United States Patent [19]

Kuusinen et al.

[11] 4,264,426

[45] Apr. 28, 1981

[54] ELECTROLYTIC CELL AND A METHOD FOR MANUFACTURING THE SAME

[75] Inventors: Osmo J. Kuusinen; Väinö O. Rintanen, both of Äetsä, Finland

[73] Assignee: Finnish Chemicals Oy, Keikyä, Finland

[21] Appl. No.: 31,537

[22] Filed: Apr. 19, 1979

[30] Foreign Application Priority Data

Jun. 6, 1978 [FI] Finland ..... 781803

[51] Int. Cl.[3] ..... C25B 9/04; C25B 11/02; C25B 11/10

[52] U.S. Cl. ..... 204/242; 204/288; 204/289

[58] Field of Search ..... 204/242, 288, 289, 279, 204/286, 267–270

[56] References Cited

U.S. PATENT DOCUMENTS

| | | | |
|---|---|---|---|
| 3,857,774 | 12/1974 | Morton et al. | 204/288 X |
| 4,014,763 | 3/1977 | Lowe | 204/242 X |
| 4,039,420 | 8/1977 | Nawrot | 204/242 X |
| 4,043,893 | 8/1977 | Gelfand | 204/288 X |
| 4,075,077 | 2/1978 | Hodges | 204/269 |
| 4,078,986 | 3/1978 | Smith | 204/286 X |

FOREIGN PATENT DOCUMENTS

| | | | |
|---|---|---|---|
| 1125493 | 8/1968 | United Kingdom | 204/286 |

*Primary Examiner*—G. L. Kaplan
*Assistant Examiner*—D. R. Valentine

[57] ABSTRACT

An electrolytic cell with a tank for the electrolyte is disclosed wherein several plate-like electrodes are fitted in the tank together with members for connecting the electrodes to the source of electric current, the members, connected to at least one pole of the source of electric current, being aluminum or, when welded with an aluminum additive, alternatively copper conductor rails or suspended conductors which have been attached to the titanium shell part on its opposite side in relation to the titanium electrodes or directly to the titanium electrodes either by gas arc welding or by welding aluminum on the titanium shell part of the electrolytic tank or on those parts of the titanium electrodes adapted to be attached to the conductors.

20 Claims, 9 Drawing Figures

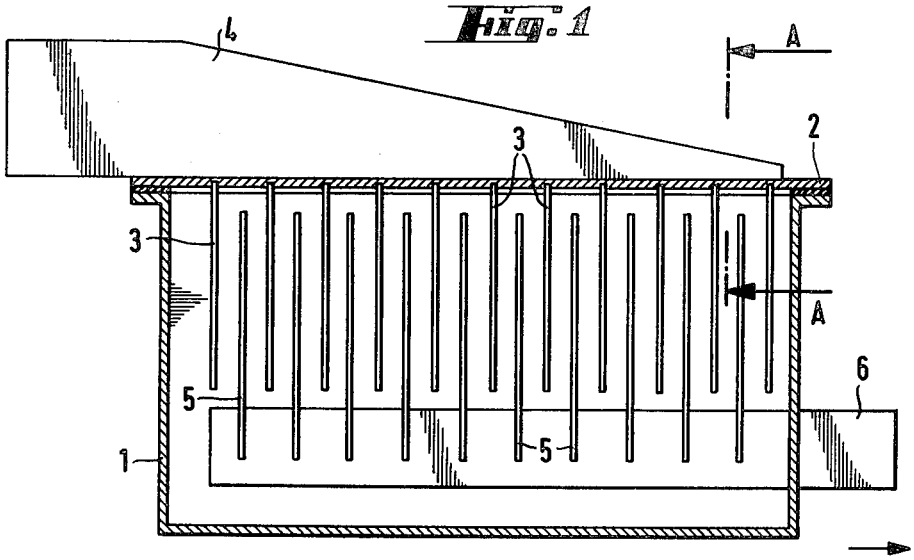
Fig. 1
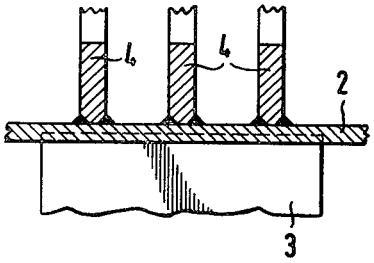
Fig. 2 (A-A)
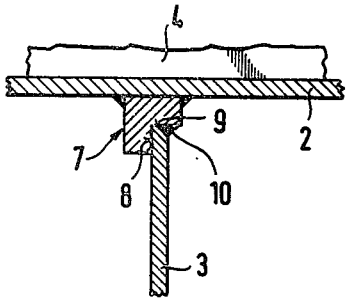
Fig. 4
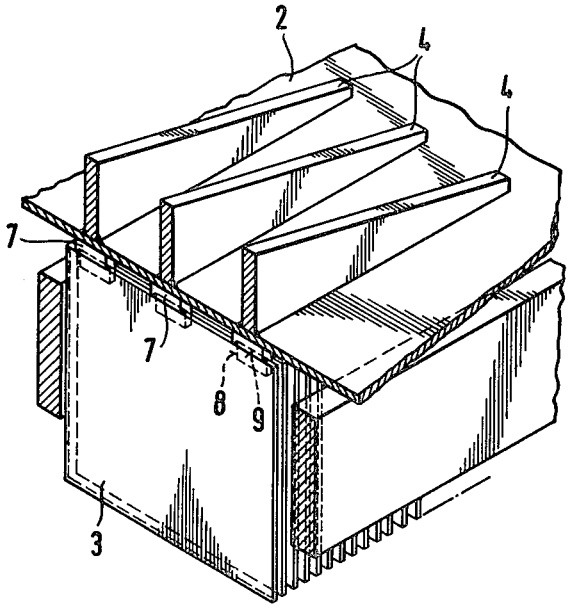
Fig. 3

Fig. 8
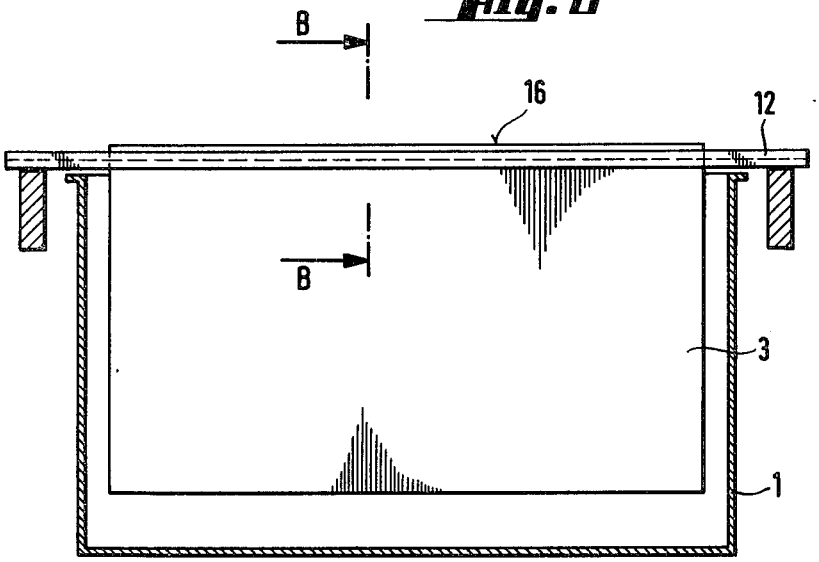
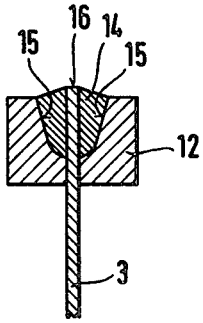
Fig. 9 (B-B)

ELECTROLYTIC CELL AND A METHOD FOR MANUFACTURING THE SAME

BACKGROUND OF THE INVENTION

The present invention relates to an electrolytic cell, in particular for the electrolytic production of chlorine and alkali, hypochlorites and chlorates, and to a method for manufacturing an electrolytic cell according to the invention, especially a method for attaching the conductor rails to the shell part of the electrolytic tank, especially to a shell part having an anode potential, and to a method for the electrolytic production of metals, especially a method for attaching suspended conductors to titanium electrodes.

Titanium anodes coated with noble metals or their oxides are very often used nowadays for the production of chlorine and alkali, hypochlorites and chlorates. These anodes are very often connected to the conductor rail by using, for example, a gasketed screw joint passing through the wall of the electrolytic tank. Joints of this type or similar joints, e.g. flange joints, can also be used for the attachment of parts made of metals other than titanium to the conductor rail. One example is the titanium tube/copper core electrode arm, in which the copper core has been attached, by a threading in it, to the anode itself, and at its other end by means of a screw joint to the wall of the electrolytic tank and to the conductor rail. All screw joints have the disadvantage that they cause transition resistance in the contact surfaces and thereby losses of energy. Screw joints inside the electrolytic tank are also disadvantageous in the respect that the electrolytic solution can enter the joint and cause corrosion, especially if different materials have been attached to each other, and in practice the gaskets used in screw joints lead to a great number of maintenance operations. Furthermore, titanium screw joints result in a long and poorly conductive titanium current path.

Aluminum conductor rails have been connected to the end of titanium electrodes even directly, without screw joints. An aluminum lump can be cast into the arm of an electrode passing through the shell part of the cell, and this aluminum lump for its part is attached by, for example, a screw joint to an aluminum conductor rail, as disclosed in British Pat. No. 1,127,484. Thereby the titanium current path becomes relatively long, and causes losses of energy owing to the poor electrical conductivity of titanium. In addition, the long arm of the electrode causes additional consumption of titanium. Casting the ends of the ribs in aluminum is a cumbersome work stage.

The joint between the conductor rail and a titanium anode has also been made by attaching the electrode by bolts to anode supports situated inside the electrolytic tank. These supports can be resistance welded in one stage to the titanium shell part, and this, for its part, can be resistance welded to an aluminum conductor, provided that the thickness of the aluminum is less than 3 mm, as explained in British Pat. No. 1,125,493. This construction has a weakness mainly in that it is not applicable to cases where the conductor rail is thick, as is the case when large flows and high flow densities are used. When thin aluminum plates are involved, the aluminum surface layer must be attached to the aluminum current conductor by a separate joint. The same is true for the other methods of coating titanium with aluminum mentioned in this patent, e.g. explosive welding. In this case the making of inlets, e.g. pipe block, becomes complicated, and furthermore, such a construction is expensive.

German Application DOS 2603626 discloses another solution for attaching an aluminum conductor rail to the shell part of a titanium electrolytic tank. In this case a copper, aluminum, steel or titanium tenon has been attached to the titanium shell part by means of friction or condenser-discharge bolt welding. The aluminum tenon can then be embedded into bores in the conductor rail and welded to the rail. This construction has a disadvantage in that, owing to the poor electrical conductivity of titanium, a large number of the said aluminum tenons are required for conducting current into the electrolytic tank.

As mentioned previously, the titanium anodes can be attached with bolts to supports welded to the inner surface of the titanium shell part, whereby transition resistance is produced in the contact surfaces. On the other hand, German Application DOS 2603626 discloses the cleat welding of an anode plate, bent at its upper edge, to the support strips. It also discloses that the anodes can be welded directly to the upper surface of the metallic base plate. The above attaching method is disadvantageous in the respect that during the welding the anode plates must somehow be directed so that they will attach to the right point.

The object of the present invention is therefore to provide an electrolytic cell in which the current path between, on the one hand, the conductor rails or suspended conductors connected to one pole of the source of current and, on the other hand, their electrodes is as short as possible and the transition resistance is as low as possible.

SUMMARY OF THE INVENTION

According to the present invention an electrolytic cell of this type has been obtained by gas arc welding and especially by MIG or TIG welding the conductor rails to the titanium shell part, with a high anode potential, of the electrolytic cell, and the suspended conductors directly to the titanium electrodes. The conductor rails and suspended conductors are preferably of aluminum, but copper rails or conductors can also be used if the welding is performed by using an aluminum additive.

According to one embodiment of the invention the anodes can be welded to anode supports or ribs or the like, welded to the inner surface of the shell part, with a notch machined to these supports or ribs, or they can be welded in a notch machined in the titanium shell part, provided that the titanium shell part is sufficiently thick, in which case the vertical wall of the notch serves as a guide for the anode and the welding is performed from the other side of the anode.

In an electrolytic cell according to the invention, transition resistance is eliminated and a short titanium current path is achieved, and it is possible to direct the anodes, on the one hand, at equal intervals from each other and, on the other hand, advantageously in relation to the feed of current.

According to the present invention the aluminum conductor rail is welded directly to the titanium shell part by MIG or TIG welding. In tensile tests performed on a welded test bar, the strength of the weld joint was observed to be equal or nearly equal to the strength of aluminum. By resistance measurements the transition resistance of the weld joint has been observed to be zero, the total resistance being the sum of the resistances of the Ti and Al bars. Thus it can be noted that by gas arc welding a contact surface with zero transition resistance is obtained between titanium and aluminum. When aluminum conductor rails are welded according to the invention, a large contact surface is obtained between aluminum and titanium. In order to obtain a contact surface with a zero transition resistance the following procedure can also be used: an aluminum layer is welded on the titanium shell part or the titanium electrode by MIG or TIG welding, and conductor rails or suspended conductors are attached to this aluminum layer by standard methods.

DESCRIPTION OF THE DRAWINGS

FIG. depicts a cross section of a side view of an electrolytic cell according to the invention;

FIG. 2 depicts a partial view, cut along line A—A in FIG 1;

FIG. 3 depicts a cross section of a perspective partial view of one alternative embodiment;

FIG. 4 depicts a cross section of a partial view of the electrolytic cell according to FIG. 3;

FIG. 8 depicts a cross section of an end view of a cell according to the invention for the electrolytic production of metals; and FIG. 9 is a section along line A—A in FIG. 8.

DESCRIPTION OF THE PREFERRED EMBODIMENTS

Figure 5:
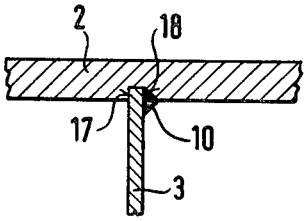
FIG. 5 depicts a cross section of a partial view of a third embodiment for attaching the anodes to the titanium shell part.

In the electrolytic cell shown in FIG. 1, the tank containing the electrolyte is indicated by 1, its titanium shell part by 2. The titanium shell part has been electrically insulated from the tank 1. By means of several adjacent wedge-shaped aluminum conductor rails the shell part 2 has been connected to the anode potential of the source of current, and several plate-like titanium electrodes 3 have been attached on the opposite side of the shell part in parallel next to each other and transversally in relation to the conductor rails 4 attached to the opposite side of the titanium shell part 2. Furthermore, conductor rails 6 connected to the cathode potential of the source of current extend into the lower section of the electrolytic tank 1; several plate-like cathodes 5 have been attached to these rails 6 and the cathodes overlap the anodes 3 at a distance from them in the electrolyte. The conductor rails can also be located in ways other than that shown in FIG. 1, depending on the wall to which the electrodes have been attached.

The present invention primarily relates to the attachment of conductor rails 4 and titanium anodes to a titanium and shell part 2 so as to obtain as short a titanium current path as possible and a low transition resistance. The wedge-like shape of the alumium current rail 4 compensates for the poorer electrical conductivity of the cathode steel conductor rails 6, thereby providing an even distribution of current. If the base material of the cathode is titanium, the method according to the invention can also be applied to the cathode side in the same manner as to the anode side.

FIG. 2 shows in more detail that the conductor rails 4 have been welded directly to the titanium shell part 2, thereby providing a simple and inexpensive structure which has no transition resistance and which ensures an even distribution of current to the titanium anodes 3 on the inner surface of the shell part 2. The conductor rails 4 have been attached to the shell part 2 by gas arc welding, preferably by MIG or TIG welding. The welding of copper conductor rails to a titanium shell part is performed by MIG or TIG welding, using an aluminum additive.

In the embodiment depicted in FIGS. 3 and 4, several supports 7 for anodes 3 or one continuous support for each anode have been welded by MIG or TIG welding at distances from each other. If the anodes 3 are attached to the shell part 2 and clearances must be left between the anodes 3 and the shell part 2 for gas flows and solution flow, several separate supports 7 can be preferably used for each anode 3. The supports 7 are of titanium and on one of their edges there has been machined a notch, parallel to those in the other supports 7 supporting the same anode 3; that wall 8 of the notch which is perpendicular to the shell part 2 serves as an anode guide and the welding to attach the anode to the other wall 9 of the notch is performed from the other side. Thus the anodes 3 can be filled at exactly the right points and be positioned precisely in relation to each other and the cathodes, and when the anodes 3 are replaced they can easily and quickly be detached from the supports 7 by grinding off the welded joint, and the new anodes 3 can thereafter be attached in the same position as the old anodes by welding, for the guide surface 8 in the notches has not been worked in connection with the replacement of the anodes 3.

According to the invention, for example, a rectangular notch can be alternatively be machined in the titanium shell part 2, provided that it is sufficiently thick, preferably, however, a notch according to FIG. 5, whereby the vertical side 17 of the notch serves as a guide for the anode 3 and the welding is performed from the other side. When the notches are of the right length and all the notches are concentric in relation to the center line of the anode group, it is easy to position the anodes also in the lateral direction. Furthermore, when welding an anode plate 3 a large contact surface is obtained between the titanium shell part 2 and the anode 3. The removal of the anodes 3 is as easy as in the case described above, but the structure has an advantage in that separate supports for the anodes 3 need not be attached to the inner surface of the titanium shell part 2. Furthermore, the titanium current path will be even shorter. When plate-like titanium anodes 3 are used, they need not be coated to the very edge, and thus any damage to the coating during the welding is eliminated (in FIGS. 6 and 7 the coating is indicated by cross-hatching).

Figure 6:
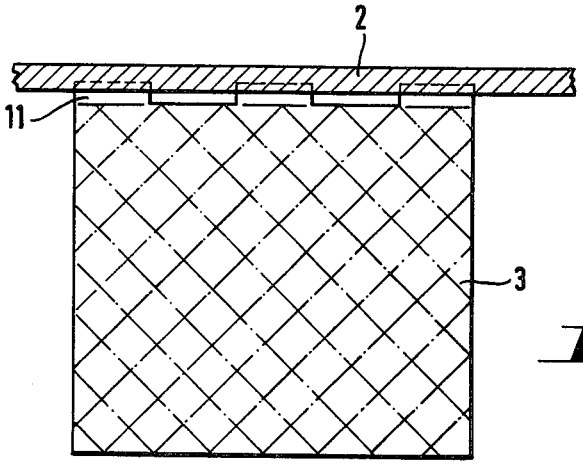
FIGS. 6 and 7 depict cross sections of partial views of the attachment of an anode with ribs and without ribs to the titanium shell part.
Figure 7:
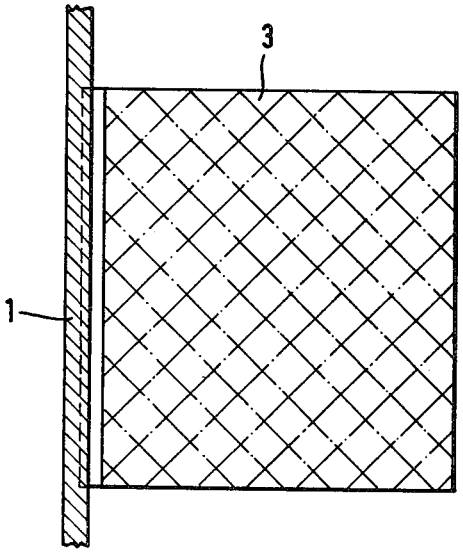

If the feed of current to the anodes 3 is from the floor or wall of the electrolytic tank, the anodes 3 can be continuous plates. If, on the other hand, current is fed through the cover 2 of the electrolytic tank 1, the removal of gas and the flow of solution can be ensured by having an anode support which is not continuous but consists of anode supports 7 at certain intervals. FIG. 3 shows one division. If, on the other hand, the anode plates 3 are attached to grooves made in the inner surface of the titanium cover 2, the titanium anode 3 can be provided with ribs 11; the gas can be discharged and the solution can circulate between them. An example of the structure is shown in FIG. 6. In the structure shown in FIG. 7 the anode 3 has been attached to the titanium shell part 2 and the anode 3 has been made without ribs. When using cathodes which have titanium as the base material, all the examples given above can also be applied to the cathode side.

FIG. 8 depicts another embodiment of the invention for metal electrolysis, in which the electrodes 3 are suspended from suspended conductors 12 so that the electrodes 3 hang in the electrolytic tank 1. As can be seen in more detail in FIG. 9, the upper end 16 of each electrode 3 has been fitted in a longitudinal clearance in the suspended conductor 12, extending through the suspended conductor in the vertical direction. The electrode 3 is titanium and the suspended conductor 12 is either copper or aluminum. Furthermore, the clearance widens upwards and the upper end of the electrode 3 has been welded in this widened part to the suspended conductor 12 so that the weld joint is pressed tightly between the slanted walls 15 of the clearance. By this procedure the electrode 3 can be attached tightly to the suspended conductor 12, since the upper end 16 of the electrode 3 wedges into the clearance.

According to the invention, the electrode 3 can be welded to the suspended conductor 12 even using other methods than those described in the examples, for example, by welding the arm of the electrode to the side of the suspended conductor or by welding the suspended conductor under a bent electrode arm.

In the electrolytic production of chlorates, titanium electrodes can be used also as cathodes, although they wear rapidly since the hydrogen produced on the cathode in statu nascendi forms titanium hydride.

In order to obtain a contact surface with zero transition resistance, the following procedure can also be used: an aluminum layer is welded by MIG or TIG welding over the titanic shell part or the titanium electrode, and current conductors are attached to this aluminum layer by normal methods, e.g. by welding or a screw joint (transition resistance between Al and Al is low).

The suspended conductor can be attached to the titanium electrodes by welding, even using other methods of joining than those described above, for example, by welding the electrode arm to the side of the suspended conductor or by welding the suspended conductor under a bent electrode arm.

What is claimed is:

1. In an electrolytic cell having a tank for an electrolyte; a titanium shell part closing the tank; insulation means for electrically insulating said shell part from said tank; a plurality of plate-like titanium electrodes disposed within the tank; and at least one connection member for electrically connecting at least one electrode to a source of electric current; the improvement comprising:

a notched electrode holding means on said shell part for receiving a portion of at least one electrode with a surface region of at least one of the plate-like sides of the electrode retained against said notched electrode holding means and for holding said electrode in position in said tank while providing part of the electrically conductive path from said source of electric current to said electrode, said notched electrode holding means including said connection member in the form of a suspended conductor bar having an aperture therethrough for receiving a portion of said electrode and in which said notched electrode holding means further includes a welded joint in said aperture between said electrode and said suspended conductor bar, said welded joint being selected from the group consisting of MIG and TIG welded joints, and suspended conductor bar aperture having the form of at least one longitudinal clearance passing through said suspended conductor bar in the vertical direction, the upper edge of the titanium electrode being attached to said suspended conductor bar by said welded joint in this clearance.

2. In an electrolytic cell having a tank for an electrolyte; a titanium shell part closing the tank; insulation means for electrically insulating said shell part from said tank; a plurality of plate-like titanium electrodes disposed within the tank; and at least one connection member for electrically connecting at least one electrode to a source of electric current; the improvement comprising:

a notched electrode holding means on said shell part for receiving a portion of at least one electrode with a surface region of at least one of the plate-like sides of the electrode retained against said notched electrode holding means and for holding said electrode in position in said tank while providing part of the electrically conductive path from said source of electric current to said electrode, said notched electrode holding means including said connection member in the form of a suspended conductor bar having an aperture therethrough for receiving a portion of said electrode and in which said notched electrode holding means further includes a welded joint in said aperture between said electrode and said suspended conductor bar, said welded joint being selected from the group consisting of MIG and TIG welded joints, said suspended conductor bar aperture having the form of at least one longitudinal clearance passing through said suspended conductor bar in the vertical direction, the upper edge of the titanium electrode being attached to said suspended conductor bar by said welded joint in this clearance, and wherein the clearance or clearances in the suspended bar widen upwards so that the upper edge of the titanium electrode with its weld joint wedges against the slanted surfaces of the upwards widening clearance or clearances.

3. In an electrolytic cell having a tank for an electrolyte; a titanium shell part closing the tank; insulation mean for electrically insulating said shell part from said tank; a plurality of plate-like titanium electrodes disposed within the tank; and at least one connection member for electrically connecting at least one electrode to a source of electric current; the improvement comprising:

a notched electrode holding means on said shell part for receiving a portion of at least one electrode with a surface region of at least one of the plate-like sides of the electrode retained against said notched electrode holding means and for holding said electrode in position in said tank while providing part of the electrically conductive path from said source of electric current to said electrode, said notched electrode holding means including an integral region on the inner face of said shell part defining one oblong groove for receiving a portion of at least one of said electrodes and in which said electrode notched holding means further includes a welded joint between the region of said shell part defining said groove and said portion of said electrode, a plurality of oblong grooves aligned in parallel, each oblong groove adapted to receive a portion of a titanium electrode, and in which each said groove is defined by first and second opposing walls joined by a third wall, said first wall of each groove being perpendicular to the plane of the shell part to position its associated titanium electrode, said second wall being slanted, and a welded joint connecting said electrode and the slanted second wall.

4. In a cell having a tank for an electrolyte and titanium electrodes disposed within said tank, the improvement comprising:

a conductor adapted to provide at least a first portion of an electrically conductive path from a source of electric current to electrolyte within said tank, said conductor being a metal selected from the group consisting of copper and aluminum, a titanium member mounted to said conductor and providing at least a second portion of said electrically conductive path from a source of electric current to electrolyte within said tank, the surface of said titanium member having aluminum added by gas arc weld thereto, said conductor being attached to said aluminum additive.

5. The improvement in accordance with claim 4 in which said conductor is a conductor rail.

6. The improvement in accordance with claim 5 in which said conductor rail is attached to said titanium member, and wherein said titanium member is a titanium shell part closing the tank.

7. The improvement in accordance with claim 4 in which said welded joint is selected from the group consisting of MIG and TIG welded joints.

8. The improvement in accordance with claim 4 in which said titanium member is an electrode.

9. The improvement in accordance with claim 8 where said conductor is in the form of a suspended conductor bar having an aperture therethrough for receiving a portion of said electrode and in which said gas arc weld is in said aperture between said electrode and said suspended conductor bar.

10. The improvement in accordance with claim 9 wherein the aperture defined by said suspended conductor gap is generally longitudinal and vertical and wherein the aperture expands upwards as defined by slanted walls in said conductor bar so that the gas arc weld is wedged between the received portion of the titanium electrode in its upper edge and the slanted walls of the suspended conductor bar.

11. The improvement in accordance with claim 4 in which said titanium member is a shell part closing the tank.

12. The improvement in accordance with claim 11 including at least one oblong support piece mounted on the inner face of said shell part and having a notch on the side facing away from the shell part, said notch being defined by two walls, one wall of the notch being perpendicular to the plane of the shell part in order to position the electrode fitted against it, said electrode being attached by a welded joint to the other wall of the notch.

13. The improvement in accordance with claim 12 in which said other wall is slanted toward said shell part.

14. The improvement in accordance with claim 12 in which said other wall is parallel to the plane of said shell part and in which said electrode has an end surface adjacent to, but slanting away from said shell part.

15. The improvement in accordance with claim 11 including an integral region on the inner face of said shell part defining at least one oblong groove for receiving a portion of at least one of said electrodes.

16. The improvement in accordance with claim 11 wherein said conductor is a conductor rail consisting of copper and wherein said gas arc weld has an aluminum additive.

17. A method of fabricating an electrolytic cell having a tank for an electrolyte, titanium electrodes disposed within the tank, a conductor adapted to provide at least a first portion of an electrically conductive path from a source of electric current to electrolyte within the tank, said conductor being a metal selected from the group consisting of copper and aluminum, said cell also having a titanium member adapted to be mounted to said conductor and providing at least a second portion of said electrically conductive path from a source of electric current to electrolyte within said tank, said method comprising the step of: adding aluminum by gas arc welding to the surface of said titanium member and attaching said conductor to said aluminum additive so as to mount said conductor to said titanium member.

18. The method in accordance with claim 17 in which said conductor is in the form of a conductor bar, and in which said conductor bar is copper, and in which the step of adding aluminum by gas arc welding said conductor to said titanium member further includes depositing a layer of aluminum on said titanium member.

19. The method in accordance with claim 17 in which said conductor is in the form of a conductor bar, and in which said conductor bar is aluminum, and in which said step of adding aluminum by gas arc welding includes welding by a welding process selected from the group consisting of the welding processes of MIG and TIG welding.

20. The method in accordance with claim 17 in which said titanium electrodes are plate-like and in which said titanium member is a shell part closing the tank having at least one support piece for receiving at least one electrode, in which each support piece defines a notch facing away from the shell part, said notch being defined by two walls, one wall of said notch being perpendicular to the surface of the shell part, and in which the method of fabricating includes the following steps:

placing said electrode in said notch with a surface region of at least one of the plate-like sides of the electrode against said one wall of the notch so as to position the electrode; and welding said electrode to said support piece on the side of the electrode opposite said one wall of said support piece.

* * * * *

UNITED STATES PATENT OFFICE
CERTIFICATE OF CORRECTION

Patent No. 4,264,426 Dated April 28, 1981

Inventor(s) Osmo J. Kuusinen and Väinö O. Rintanen

It is certified that error appears in the above-identified patent and that said Letters Patent are hereby corrected as shown below:

Col. 3, line 17, after "FIG." insert --1--;
Col. 3, line 60, cancel "and".

Col. 8, line 15, cancel "gas arc weld has an";
Col. 8, line 16, after "additive" insert --is a deposited layer of aluminum--
Col. 8, line 24, cancel "also".

Signed and Sealed this

*Twenty-first* Day of *July 1981*

[SEAL]

*Attest:*

GERALD J. MOSSINGHOFF

*Attesting Officer*

*Commissioner of Patents and Trademarks*